US009850662B2

(12) United States Patent
Hensley

(10) Patent No.: US 9,850,662 B2
(45) Date of Patent: Dec. 26, 2017

(54) FLEXIBLE EXPANSION JOINT SEAL

(71) Applicant: EMSEAL JOINT SYSTEMS LTD., Westborough, MA (US)

(72) Inventor: Lester Hensley, Westborough, MA (US)

(73) Assignee: EMSEAL JOINT SYSTEMS LTD., Westborough, MA (US)

( * ) Notice: Subject to any disclaimer, the term of this patent is extended or adjusted under 35 U.S.C. 154(b) by 0 days.

(21) Appl. No.: 15/135,015

(22) Filed: Apr. 21, 2016

(65) Prior Publication Data

US 2016/0237689 A1 Aug. 18, 2016

Related U.S. Application Data

(63) Continuation of application No. 13/652,021, filed on Oct. 15, 2012, now Pat. No. 9,322,163.
(Continued)

(51) Int. Cl.
*E01D 19/06* (2006.01)
*E04D 13/15* (2006.01)
(Continued)

(52) U.S. Cl.
CPC ..... *E04D 13/151* (2013.01); *E04B 1/6813* (2013.01); *E04D 13/1415* (2013.01); *E04B 1/681* (2013.01)

(58) Field of Classification Search
CPC .. E04D 13/151; E04B 31/6807; E04B 1/6813
See application file for complete search history.

(56) References Cited

U.S. PATENT DOCUMENTS 2,230,688 A * 2/1941 Irwin ..... E01C 11/106 16/7
2,258,078 A * 10/1941 Tennison ..... E04D 13/0445 52/13
(Continued)

FOREIGN PATENT DOCUMENTS

JP 04005353 A * 1/1992
JP 05025865 A * 2/1993
(Continued)

OTHER PUBLICATIONS

MM Systems Corporation, MM LMS Expansion Joint, Spec Data "LokCrete Membrane Sealing System", Nov. 13, 2012; 2 pages.
(Continued)

*Primary Examiner* — Elizabeth A Quast
(74) *Attorney, Agent, or Firm* — MKG LLC

(57) ABSTRACT

An expansion joint seal includes a central portion having at least one central chamber disposed around a centerline, a first flange portion extending outwardly from the centerline and a second flange portion extending outwardly from the centerline in a direction opposite the first flange portion. When installed on the structure, the first flange portion is attachable to a first substrate of the structure and the second flange portion is attachable to a second substrate of the structure such that the central portion is disposed within and seals a gap formed between the first substrate and the second substrate of the structure. Movement of one or both of the first substrate and the second substrate causes a response in the central portion to maintain the seal.

9 Claims, 10 Drawing Sheets

Related U.S. Application Data

(60) Provisional application No. 61/547,476, filed on Oct. 14, 2011.

(51) Int. Cl.
*E04B 1/68* (2006.01)
*E04D 13/14* (2006.01)

(56) References Cited

U.S. PATENT DOCUMENTS 3,114,219 A * 12/1963 Bradley ..... E04B 1/6807 249/205
3,264,790 A * 8/1966 Beals ..... E04D 3/40 52/14
3,286,425 A * 11/1966 Brown ..... E04B 1/6815 404/64
3,352,649 A * 11/1967 Tennison, Jr. ..... B21D 5/08 29/897.3
3,355,846 A * 12/1967 Tillson ..... E04B 1/68 49/493.1
3,410,037 A * 11/1968 Empson ..... E04D 13/151 52/309.9
3,643,388 A * 2/1972 Parr ..... E04D 13/151 52/277
3,667,174 A * 6/1972 Arnett ..... E04B 1/6807 52/100
3,670,470 A * 6/1972 Thom ..... E04D 13/151 52/395
3,956,557 A * 5/1976 Hurst ..... E04B 1/6806 428/167
4,007,994 A * 2/1977 Brown ..... E01D 19/06 14/73.1
4,018,017 A * 4/1977 Schoop ..... E04D 13/151 52/396.07
4,055,925 A * 11/1977 Wasserman ..... E04D 13/151 428/468
4,295,315 A * 10/1981 Lynn-Jones ..... E04B 1/6804 14/73.1
4,362,428 A * 12/1982 Kerschner ..... E01C 11/106 404/64
4,374,442 A * 2/1983 Hein ..... E01D 19/06 14/73.1
4,447,172 A * 5/1984 Galbreath ..... E01D 19/06 404/65
4,449,333 A * 5/1984 Stratton ..... E04D 3/40 52/13
4,625,485 A * 12/1986 Nicholas ..... E04B 1/6804 404/64
4,637,085 A * 1/1987 Hartkorn ..... E01D 19/06 14/73.1
4,773,791 A * 9/1988 Hartkorn ..... E01D 19/06 404/56
4,781,003 A * 11/1988 Rizza ..... E04B 1/6815 404/69
4,799,345 A * 1/1989 Rizza ..... E04B 1/6813 404/65
4,815,247 A * 3/1989 Nicholas ..... E04B 1/6803 404/47
4,848,044 A * 7/1989 LaRoche ..... E04B 1/6804 404/68
4,866,898 A * 9/1989 LaRoche ..... E04B 1/6804 52/396.01
4,882,890 A * 11/1989 Rizza ..... E04D 13/151 52/395
4,916,878 A * 4/1990 Nicholas ..... E04B 1/6803 404/47
5,035,533 A * 7/1991 Brown ..... E01D 19/06 404/64
5,115,603 A * 5/1992 Blair ..... E04D 13/0445 52/11
5,130,176 A * 7/1992 Baerveldt ..... B32B 5/32 428/192
5,213,441 A 5/1993 Baerveldt
5,313,755 A * 5/1994 Koenig, Jr. ..... E04F 13/06 52/255
5,338,130 A * 8/1994 Baerveldt ..... E01D 19/06 264/173.17
5,365,713 A * 11/1994 Nicholas ..... E04B 1/681 52/396.03
5,477,643 A * 12/1995 Koenig, Jr. ..... E04F 13/06 52/100
5,575,126 A * 11/1996 Attaway ..... E04B 1/6804 404/48
5,584,152 A * 12/1996 Baerveldt ..... B29C 47/0019 404/67
5,625,986 A * 5/1997 Mansfield ..... E04F 13/04 52/255
5,628,857 A * 5/1997 Baerveldt ..... B29C 47/0019 156/244.25
5,887,400 A * 3/1999 Bratek ..... E04B 1/681 52/393
6,491,468 B1 * 12/2002 Hagen ..... E04B 1/6803 277/316
6,751,919 B2 * 6/2004 Calixto ..... E04B 1/6816 404/49
6,948,287 B2 * 9/2005 Korn ..... E04B 1/68 277/510
6,948,716 B2 * 9/2005 Drouin ..... E04B 1/6807 277/606
7,240,905 B1 * 7/2007 Stahl, Sr. ..... E04B 1/681 277/652
7,600,356 B2 * 10/2009 Benjamin ..... E04F 13/04 52/461
7,757,450 B2 * 7/2010 Reyes ..... E04F 13/06 14/73.5
8,333,532 B2 * 12/2012 Derrigan ..... E01C 11/106 404/47
8,365,495 B1 * 2/2013 Witherspoon ..... E04B 1/948 404/68
8,720,138 B2 * 5/2014 Hilburn, Jr. ..... E04B 1/948 52/232
9,322,163 B1 * 4/2016 Hensley ..... E04B 1/6813
2002/0023926 A1 * 2/2002 Dhellemmes ..... B65D 90/022 220/586
2005/0066600 A1 * 3/2005 Moulton ..... E04B 1/6813 52/393
2006/0117692 A1 * 6/2006 Trout ..... E04B 1/6801 52/393
2006/0288652 A1 * 12/2006 Gurr ..... E04D 13/103 52/198
2007/0256380 A1 * 11/2007 Toffolo ..... E01C 11/106 52/396.06
2007/0261342 A1 * 11/2007 Cummings ..... E04D 13/151 52/393
2014/0219719 A1 * 8/2014 Hensley ..... E01C 11/14 404/57

FOREIGN PATENT DOCUMENTS

JP 06026166 A * 2/1994
JP 06288017 A * 10/1994

OTHER PUBLICATIONS

Erie Metal Specialties, "Winged Joint Systems DW-Series"; 1 page.
Emseal Thermaflex Tech Data, "Watertight Parking-Deck and Stadium Expansion Joint Systems", data sheet Nov. 2014, pp. 1-4.
Archi Expo, Tecno K Giunti, "PVC expansion joint/roof/waterproof- K Roof TPO", pp. 1-13.
Migua Fugensysteme GmbH & Co. KG, Wulfrath, "Corrugated jointing system for sealing against non-pressurized water (DIN 18195)", WFB 550, 4 pages.

* cited by examiner

FLEXIBLE EXPANSION JOINT SEAL

CROSS-REFERENCE TO RELATED APPLICATIONS

The present application claims the benefit of U.S. Non-Provisional patent application Ser. No. 13/652,021, filed Oct. 15, 2012, now U.S. Pat. No. 9,322,163, entitled "FLEXIBLE EXPANSION JOINT SEAL" which claims the benefit of U.S. Provisional Patent Application Ser. No. 61/547,476, filed Oct. 14, 2011, entitled "THERMOPLASTIC EXPANSION JOINT SEAL FOR ROOFS," the contents of each of which are hereby incorporated by reference in its entirety.

FIELD OF THE INVENTION

The present invention is generally directed to joint sealing systems, and more particularly, to systems for sealing structural expansion joint openings in roofs of structures.

BACKGROUND OF THE INVENTION

In many construction projects involving materials such as concrete and steel, gaps are left between adjacent structural elements to allow for thermal expansion and contraction, wind sway, settlement, live load deflection, and/or seismic movements of the structural elements. By permitting expansion and contraction, the gaps prevent the structural materials and/or building cladding elements from cracking or buckling. These gaps are referred to as expansion joints or movement joints and are typically sealed to prevent them from allowing the passage of water, dirt, debris, or snow, etc. into the structure and/or between portions of the structure.

Current systems for sealing exterior expansion joints in the roofs of structures typically consist of a length of flexible material or membrane that spans a length and width of the joint between adjacent elements and is attached to each side of the joint by anchor bars that are screwed or bolted to the substrate. The membrane, usually a sheet of rubber or the like, is wider than the joint itself to seal the joint and to allow for movement of the structural materials with the joint. Two designs have been developed to address the issue of debris collecting on top of the membrane and straining the seal. FIG. 1 shows a prior art example of a roof expansion joint seal 10 manufactured by Johns Manville (Denver, Colo. USA). In this design, a membrane 12 is humped up above a joint J by a foam backing 14 to seal S the joint J. FIG. 2 shows a prior art example of a roof expansion joint seal 20 manufactured by MM Systems Corporation (Pendergrass, Ga. USA). This design includes a metal cover 24 over a membrane 22, which is allowed to hang into the joint J to form the seal S. As shown in FIG. 1, the roof expansion joint seal 10 is affixed about the joint J by one or more fasteners 16 through a flange 18 of the roof expansion joint seal 10. Similarly, as shown in FIG. 2, the roof expansion joint seal 20 is affixed about the joint J by fasteners 26 through a lip or flange 28 of the roof joint seal 20.

Problems may arise with either joint seal 10 and 20 in several areas. For example, the fasteners 16 and 26 are exposed to weather conditions and the seals may fail as they deteriorate and no longer effectively anchor the seals 10 and 20 about the joint J. Additionally, the seals 10 and 20 provide only a single layer of waterproofing, increasing the chances of failure of the seals. Finally, the shape of the membrane 16 and 22, whether hanging down or humped up, makes it difficult to transition from a horizontal roof expansion joint to a vertical wall expansion joint without compromising the continuity of the seals or undertaking significant modifications to the seals 10 and 20 in the field.

SUMMARY OF THE INVENTION

According to aspects illustrated herein, there is provided an expansion joint seal. The expansion joint seal comprises a central portion having at least one central chamber disposed around a centerline. The central portion is disposed within and fills a gap between a first substrate and a second substrate of a structure of interest such a roof. The expansion joint seal has a first flange portion extending outwardly from the centerline and a second flange portion extending outwardly from the centerline in a direction opposite the first flange portion. The first flange portion is attachable to the first substrate and the second flange portion is attachable to the second substrate. Movement of one or both of the first or second substrates causes a response in at least one of the central chambers.

In one embodiment, at least one of the first flange portion and the second flange portion is comprised of a flexible materials such that the at least one of the first flange portion and the second flange portion may be affixed to the structure at an angle or an elevation that differs from the central portion. In one embodiment, at least one of the first flange portion and the second flange portion is bifurcated into an upper flange portion and a lower flange portion. The upper flange portion extends further in length from the centerline than the lower flange portion to facilitate interlaying the expansion joint seal with roofing materials to form a water tight seal of the structure.

DETAILED DESCRIPTION OF PREFERRED EMBODIMENTS

The present invention alleviates perceived problems associated with current rooftop expansion joint systems by including, for example, redundant levels of waterproofing, a dual flange apparatus, which protects the anchors and enhances the seal, and the ability to manufacture transitions that can be integrated into coplanar, perpendicular and other expansion joints.

Figure 1:
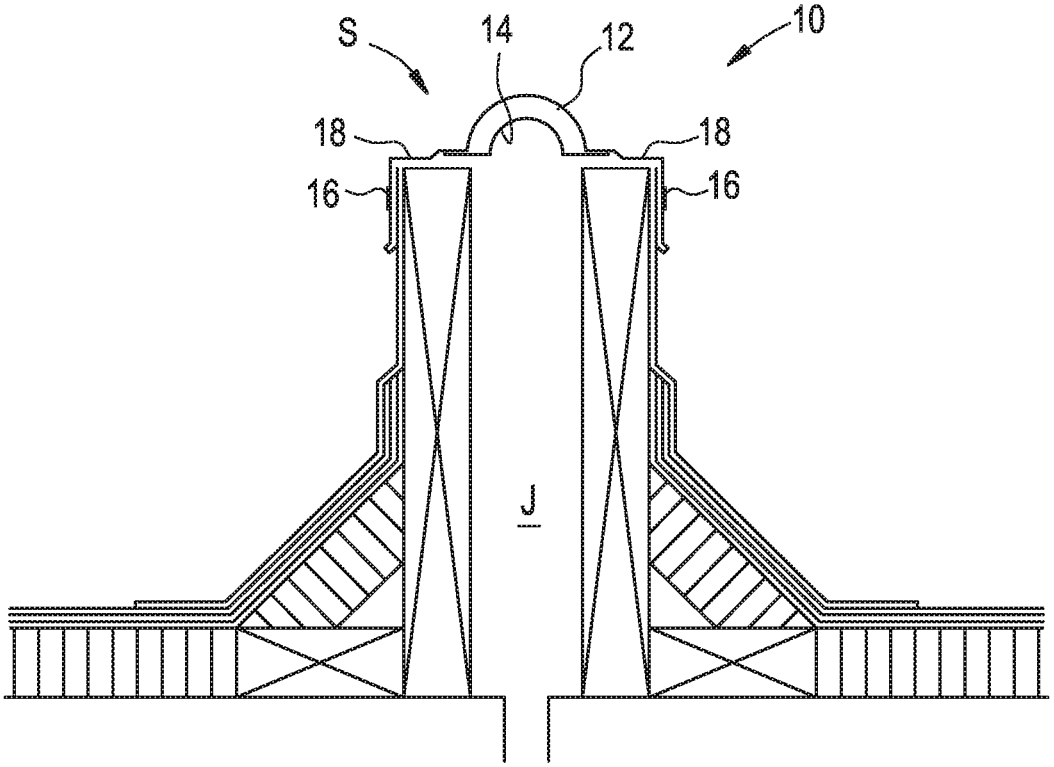
FIG. 1 PRIOR ART
FIG. 1 is a cross-sectional view of a prior art roof expansion joint seal.
Figure 2:
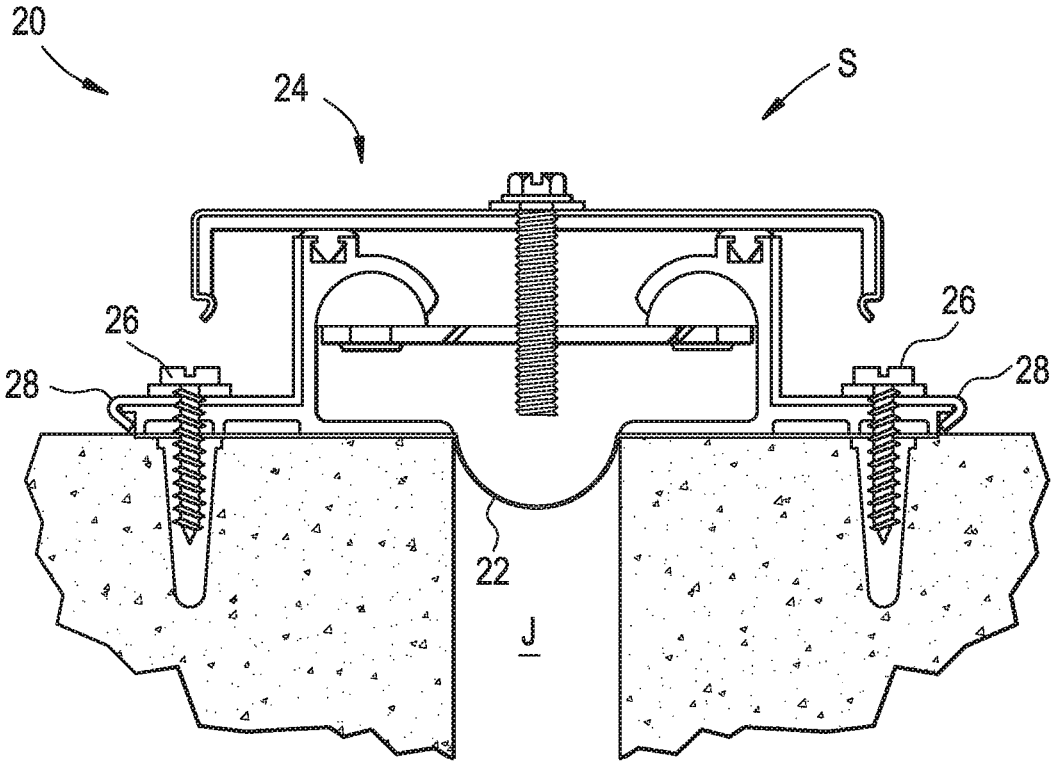
FIG. 2 PRIOR ART
FIG. 2 is a cross-sectional view of a prior art roof expansion joint seal.
Figure 3:
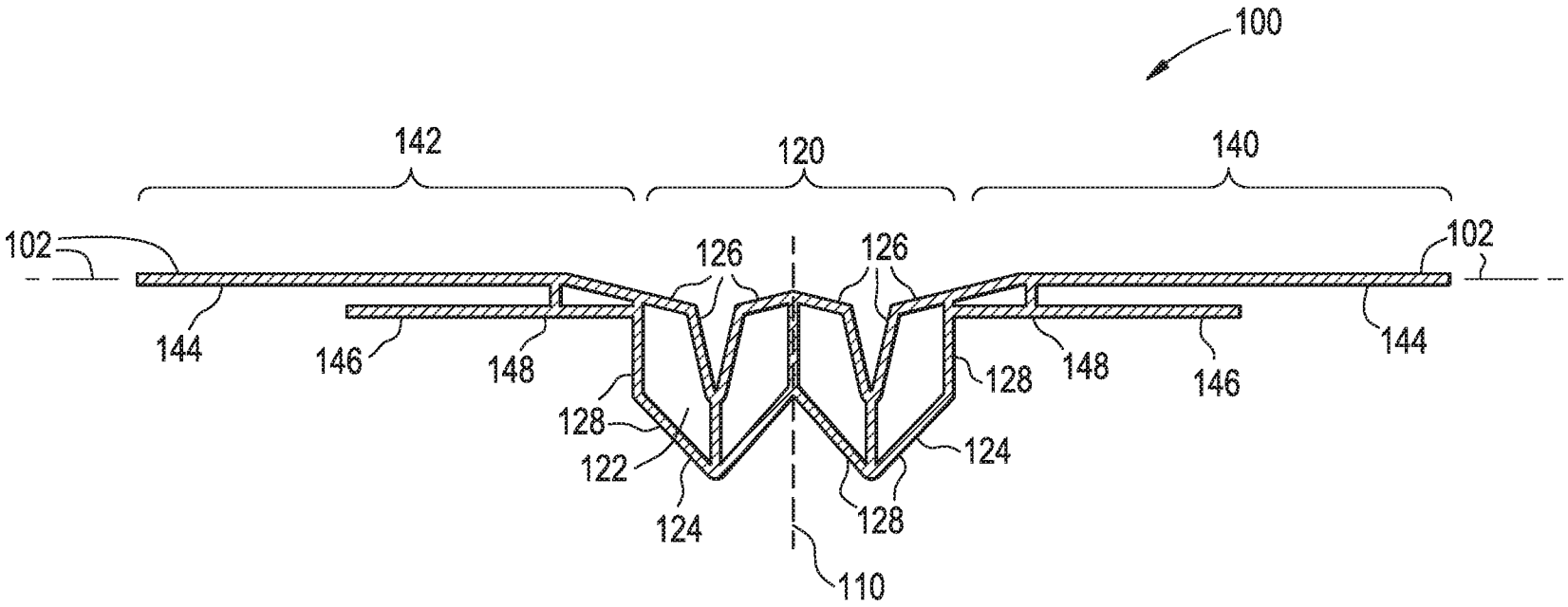
FIG. 3 is an end view of an expansion joint seal in accordance with one embodiment of the present invention before installation.
Figure 4:
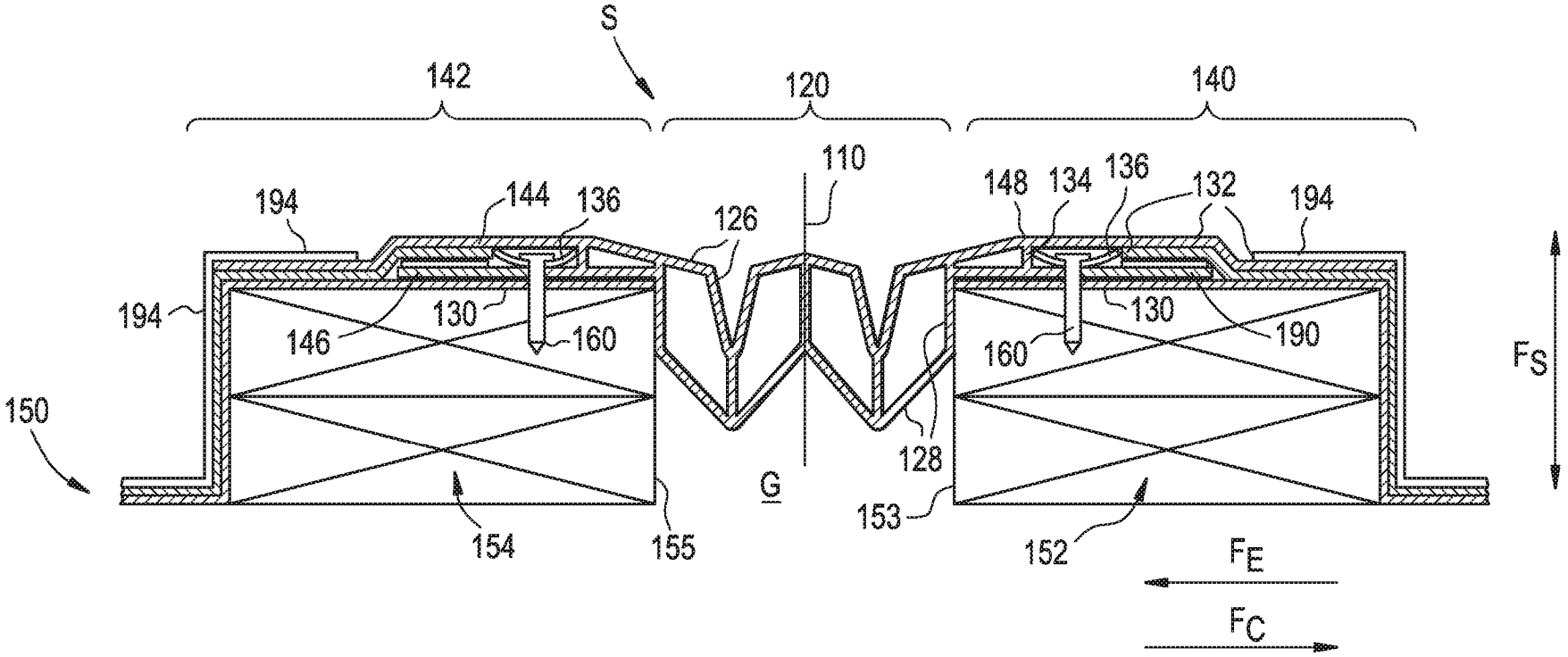
FIG. 4 is a cross-sectional view of the expansion joint seal of FIG. 3 as installed on two substantially parallel substrates.
Figure 5:
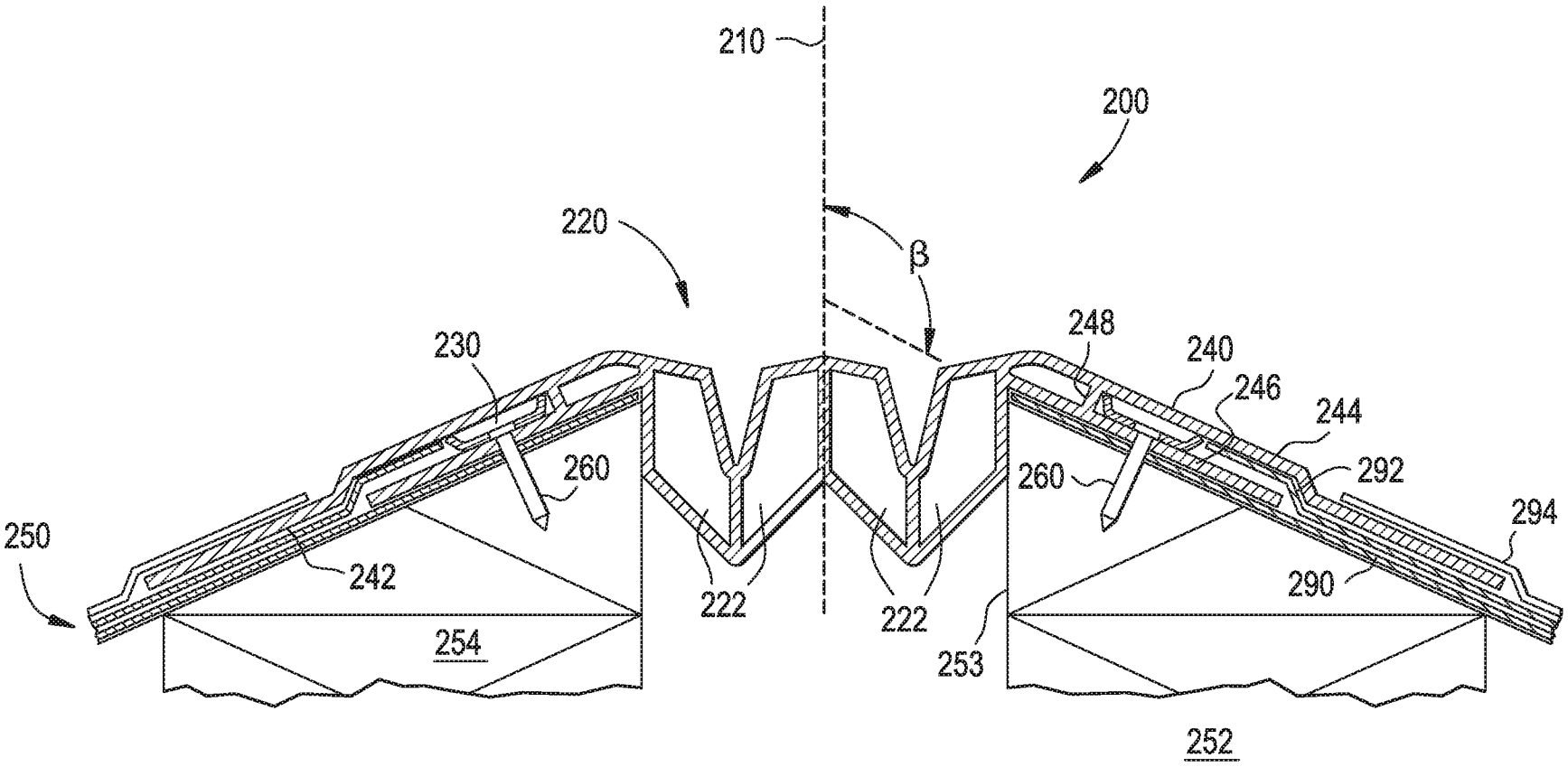
FIG. 5 is a cross-sectional view of the expansion joint seal of FIG. 3 as installed on two peaked or sloped substrates.
Figure 6:
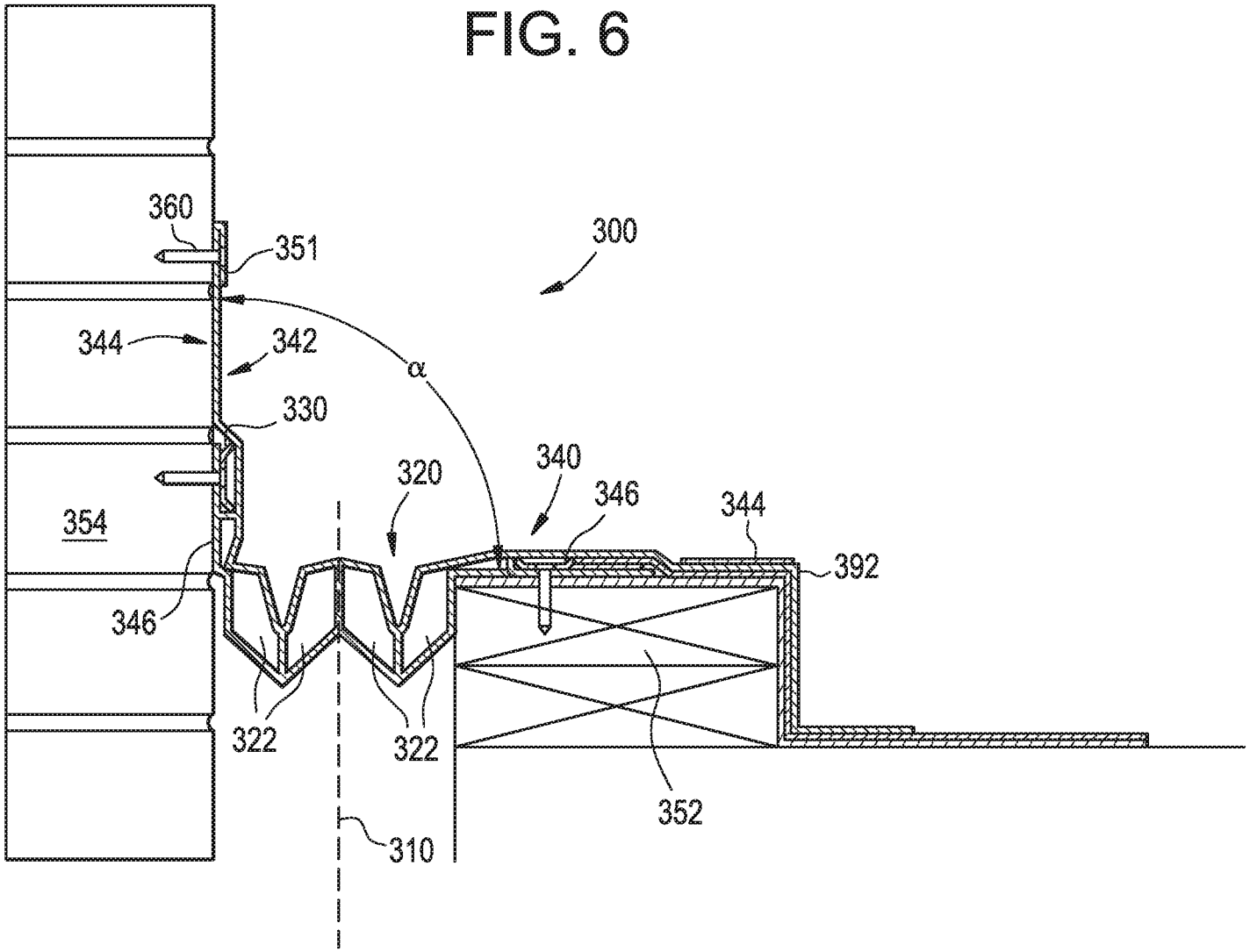
FIG. 6 is a cross-sectional view of the expansion joint seal of FIG. 3 as installed on two substantially perpendicular substrates.

Referring to FIG. 3, an expansion joint seal 100 consists of a central portion 120 disposed around a centerline 110 of the seal 100 and at least one of a first flange portion 140 and a second flange portion 142. A first continuous surface 102 of the joint seal 100 is defined by the center portion 120, the first flange portion 140, and the second flange portion 142. As described in detail below, when installed and affixed on a roof of a structure, the joint seal 100 is integrally incorporated with roofing materials on the roof such that the first surface 102 forms a seal S of a joint or gap G between structural elements of the roof (FIG. 4). As shown in FIG. 3, each of the first flange portion 140 and the second flange portion 142 extend outwardly from the centerline 110. As described above, in one embodiment the joint seal 100 is comprised of a flexible material such as, for example, a thermoplastic compound so that the first flange portion 140 and the second flange portion 142 may be affixed to a structure at differing angles and/or elevations relative to the central portion 120 and/or each other. For example, as shown in FIG. 4, the first flange portion 140 and the second flange portion 142 are coplanar in alignment at installation on structural elements 152 and 154 of a roof 150. In another installation as shown in FIG. 5, each of a first flange portion 240 and a second flange portion 242 of a joint seal 200 are installed at an angle β, shown here at approximately one hundred ten degrees (110°) relative to a centerline 210 of the joint seal 200. In another installation as shown in FIG. 6, a first flange portion 340 and a second flange portion 342 of a joint seal 300 are formed at an angle α to each other shown here, for example, at ninety degrees (90°) relative to a centerline 310. It should be understood that the angles β or a could be any degree relative to a centerline. It should further be understood that during use, the first flange portions 140, 240, 340 and the second flange portion 142, 242, 342 may move relative to the centerlines 110, 210, 310 despite the angles at initial installation. It should be appreciated that the roof expansion joint seals 200 (FIGS. 5) and 300 (FIG. 6) are substantially similar to the roof expansion joint seal 100 of FIGS. 3 and 4. As such, similar numbering conventions are used to relate to similar components of these seals 100, 200 and 300.

As described below, the expansion joint seals 100, 200, 300, 400 (FIGS. 7 and 8), 500 (FIGS. 9), 600 and 700 (FIG. 10) of the present invention are made from a flexible material. In one embodiment, the flexible material is a thermoplastic compound such as, for example, thermoplastic elastomers (TPEs) which could be of the families of thermoplastic vulcanizates (TPVs), such as Santoprene® (Exxon Mobil Corp., Irving, Tex.); or thermoplastic olefins (TPOs), such as OnFlex®(PolyOne Corp., Avon Lake, Ohio); or polyvinyl chloride (PVC) compounds such as FlexAlloy® (Teknor Apex Co., Pawtucket, R.I.). Thermoplastic rubber compounds are preferable to thermoset rubber compounds due to their ability to be welded to roof membrane materials of similar compounds as well as to facilitate the fabrication of heat-welded transitions in plane and direction. In one embodiment, the method of manufacture is extrusion because it permits a single cross-section design to be extended consistently throughout any desired length. In one embodiment, the expansion joint seals 100, 200, 300, 400, 500 and 600 are manufactured to fit the lengths of specific expansion joints.

Referring again to FIG. 3, in one embodiment, at least one of the first flange portion 140 and the second flange portion 142 is bifurcated into an upper flange portion 144 and a lower flange portion 146. In one embodiment, the upper flange portion 144 and the lower flange portion 146 are separated by a support wall 148 formed therebetween. As shown in FIG. 3, both the first flange portion 140 and the second flange portion 142 are bifurcated into the upper flange portion 144 and the lower flange portion 146, but it should be appreciated that this is not a requirement of the present invention. In one embodiment, the support wall 148 is substantially perpendicular to the upper flange portion 144 and the lower flange portion 146. In one embodiment, the support wall 148 extends the length of the expansion joint seal 100. In one embodiment illustrated in FIG. 8, an upper flange portion 440 of an expansion joint seal 400 (shown in partial cross section) is raised during installation so that the joint seal 400 may be affixed to a structure of interest 452 by one of a plurality of fasteners 460 affixed through a hole 441 in a lower flange portion 446 of the joint seal 400.

Figure 7:
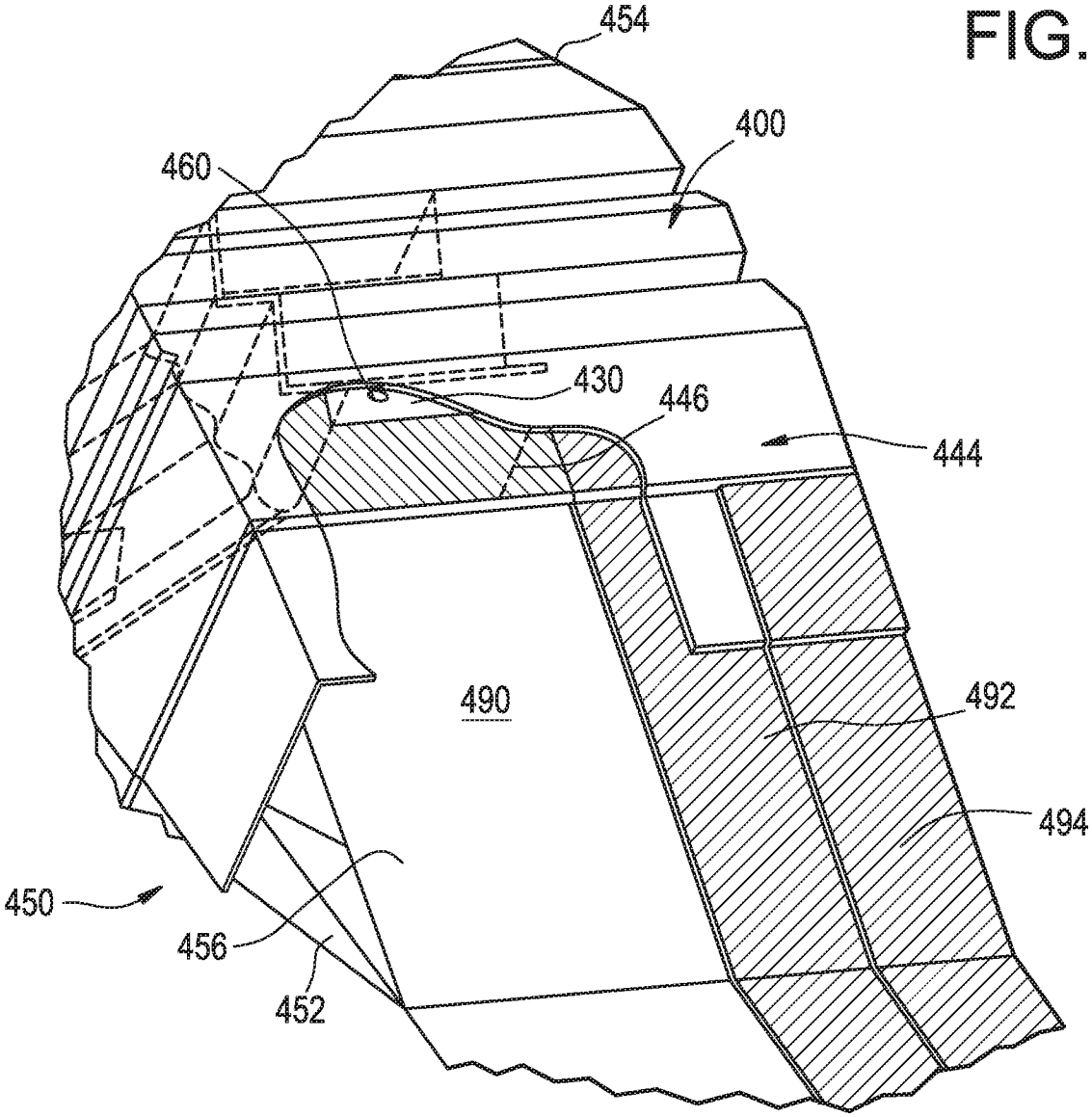
FIG. 7 is a perspective view of the expansion joint seal of FIG. 3 as installed showing an upper flange portion and a lower flange portion.
Figure 8:
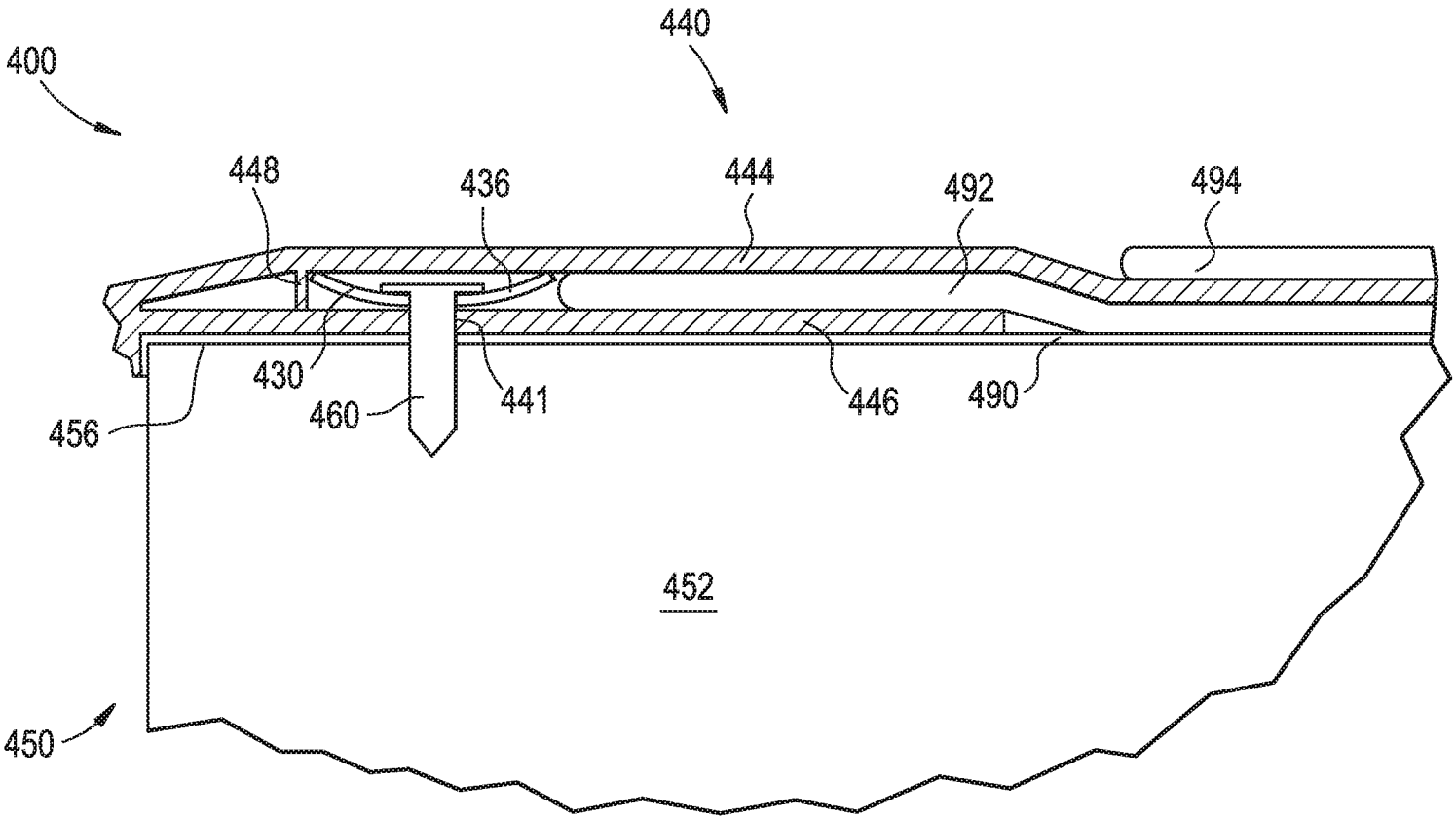
FIG. 8 is a partial cross-sectional view of a bracket (flange) with a fastener therethrough as used with the expansion joint seal of FIG. 3.

In one embodiment, as best illustrated in FIGS. 4, 5 and 8, the upper flange portion 144, 244, 444 extends further in length away from the centerline 110, 210, 410 of the joint seal 100, 200, 400 than the lower flange portion 146, 246, 446 such that the upper flange portion 144, 244, 444 cooperates with roofing materials 190, 290, 490 (e.g., in an interlaying manner) to provide a watertight seal with the roofing materials applied over the roof 150, 250, 450. The roofing materials are described in further detail below with reference to FIGS. 7 and 8. In another embodiment shown in FIG. 6, an upper flange portion 344 is secured to a structure of interest (e.g., a second substrate 354 of the structure) by a fastener 360 through a hole 351 in the upper flange portion 344.

Referring again to FIG. 3, the central portion 120 includes at least one central chamber 122. In one embodiment the central chamber 122 includes two or more chambers, e.g. four (4) chambers shown in FIG. 3. The central chamber 122 is formed by a side wall 124. In one embodiment, the central chamber 122 extends a length of the seal 100. In one embodiment, the side wall 124 of the central chamber 122 is configured to be selectively collapsible in response to forces exerted on the side wall 124. For example, in one embodiment, the side wall 124 of the central chamber 122 is configured into a generally pentagonal cross-section (e.g., five-sided cross-section). It should be understood that the shape of the central chambers 122, as defined by the side wall 124, can be of any selectively collapsible configuration that permits compression and expansion movement of the central chamber 122 in response to forces exerted on the side wall 124 while retaining, in an uninterrupted fashion, the first continuous surface 102 of the expansion joint seal 100. The number of central chambers 122 included within the central portion 120 can likewise be varied to accommodate different widths of expansion joint openings (e.g., widths of gap G (FIG. 4)). As shown in FIGS. 3 and 4, the side wall 124 includes a first outer surface 126 integrally formed within the first continuous surface 102 of the joint seal 100, and a second outer surface 128 opposite the first continuous surface 102. As forces from, for example, expansion (FE) of the roof 150, and/or structural elements thereof 152 and 154, is exerted on the second outer surface 128 of the side wall 124, the central chamber 122 deforms or contracts (compresses) in response to the expansion force. Similarly, as forces from, for example, contraction (Fc) of the roof 150 is directed away from the second outer surface 128 of the side wall 124, the central chamber 122 deforms or expands in response to the contraction force.

As shown in FIG. 4, in one embodiment, the first flange portion 140 is affixed to a first substrate 152 of the roof 150 by one or more fasteners 160. The second flange portion 142 is affixed to a second substrate 154 by one or more of the fasteners 160. The central portion 120 is disposed within and fills a gap G in the roof 150 between the first substrate 152 and the second substrate 154, such as, for example, a structural expansion joint opening in the roof 150 of a structure. In one embodiment, when installed the outer surface 128 of the side wall 124 engages, for example, with an inner surface 153 of the first substrate 152 and an inner surface 155 of the second substrate 154. As one or both of the first substrate 152 and the second substrate 154 expands or contracts in response to, for example, one or more of thermal expansion or contraction, sway, settlement, live load deflections and/or seismic movement of the roof 150 and/or structural members thereof, the inner surfaces 153 and/or 155 exert forces toward (expansion FE) or away from (contraction $F_C$) the outer surface 128, or perpendicular to (sway, settlement Fs) forces $F_E$ and $F_C$. The shape and position of the central chambers 122 allows the central portion 120 to expand and contract responsive to forces placed on the second outer surface 128 and the side wall 124 by the inner surfaces 153, 155 of the first substrate 152 and the second substrate 154, respectively, and maintain the seal S of the gap G. As shown in FIGS. 3-6, in one embodiment, the central portions 120, 220, 320 are comprised of four (4) central chambers 122, 222, 322 arranged in mirrored sets of two chambers opposite the center line 110, 210, 310.

Figure 9:
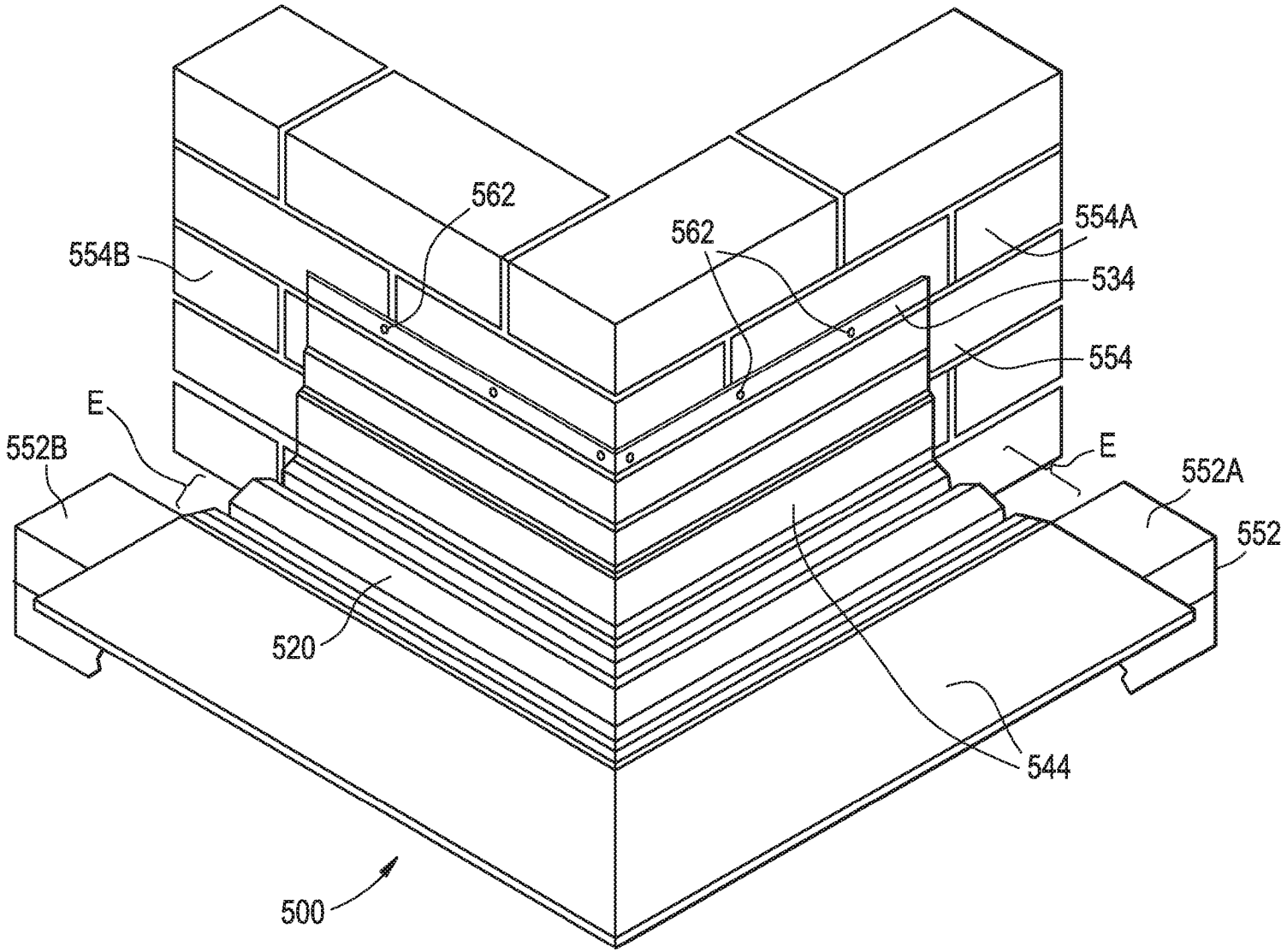
FIG. 9 is a perspective view of the expansion joint seal of FIG. 3 as installed around a corner.

As shown in FIG. 4, in one embodiment, an anchor bar 136 is disposed between the upper flange portion 144 and the lower flange portion 146 along a length of the seal 100. In one embodiment, the anchor bar 130 is comprised of sufficiently rigid material such as, for example, metal, a rigid polymer, or the like, to impart a clamping force continuously along the length of the lower flange portion 146 between the fasteners 160. Tool member 130 is also shown in FIG. 4. Referring to FIG. 8, an anchor bar 430, 436 is disposed between the upper flange portion 444 and the lower flange 446 and receives one or more fasteners 460. Roofing materials 490, 492, 494 are interlayed and cooperate with the upper flange portion 444 and the lower flange 446 to form a water tight seal of the roof 450. In one embodiment shown in FIG. 9, a roof joint seal 500 may be installed to a first substrate 552 such as, for example, a deck or flat roof portion, and a second substrate 554 such as, for example, a wall, to fill an expansion joint E therebetween. As shown in FIG. 9, the roof joint seal 500 may be configured to accommodate the expansion joint E that turns a corner. In another embodiment shown in FIG. 10, a joint seal 600 accommodates a T-intersection wherein it is attached to a first substrate 652, a second substrate 654 and a third substrate 656.

Referring to FIGS. 7 and 8, in one embodiment at least one of the first substrate 452 and the second substrate 454 are covered with a layer of the watertight roofing membrane 490 and engage for example, an upper surface 456 of the first substrate 452. In one embodiment, the lower flange portion 446 engages a first layer of the watertight roofing membrane 490. In another embodiment, the lower flange portions 446 are attached to the watertight roofing membrane 490 with a tar, adhesive of the like. In another embodiment, the lower flange portion 446 is attached to the first layer of the watertight roofing membrane 490 by welding. In another embodiment, the lower flange portion 446 is fixed to at least one of the first substrate 452 and the second substrate 454 by one of the plurality of fasteners 460 disposed through the hole 441 of the lower flange portion 446 and of the anchor bar 430. A second watertight roofing membrane 492 may then be disposed over the lower flange portions 446. In one embodiment, the second watertight roofing membrane 492 is heat-welded or otherwise adhered to the lower flange portion 446, effectively integrating the lower flange portion 446 into the roof membranes 490 and 492. In one embodiment, the upper flange portion 444 is disposed over the second water tight roofing membrane 492 and is heat-welded or otherwise adhered thereto. In this embodiment, the anchor bar 430 and the plurality of fasteners 460 are shielded from the harmful effects of moisture and environmental exposure by the upper flange portion 444. A third watertight roofing membrane 494 may then be disposed about at least a portion of the upper flange portion 444 and heat-welded or otherwise adhered thereto. This process provides a waterproof seal S over the joint by positively integrating the expansion joint seal 400 into the roofing materials (e.g., membranes 490, 492 and 494) of the roof 450.

Referring to FIG. 9, an expansion joint seal 500 is attached to a first portion 552A and a second portion 552B of a first substrate 552 forming a corner. A second substrate 554 extending vertically upward from the first substrate 552 also forms a corner having a first portion 554A and a second side portion 554B. An expansion joint between the first substrate 552 and the second substrate 554 is generally indicated at E. In one embodiment, an upper flange portion 544 is attached to the first portion 554A and the second portion 554B by an anchor bar 534 and a plurality of fasteners 562 disposed therethrough.

Figure 10:
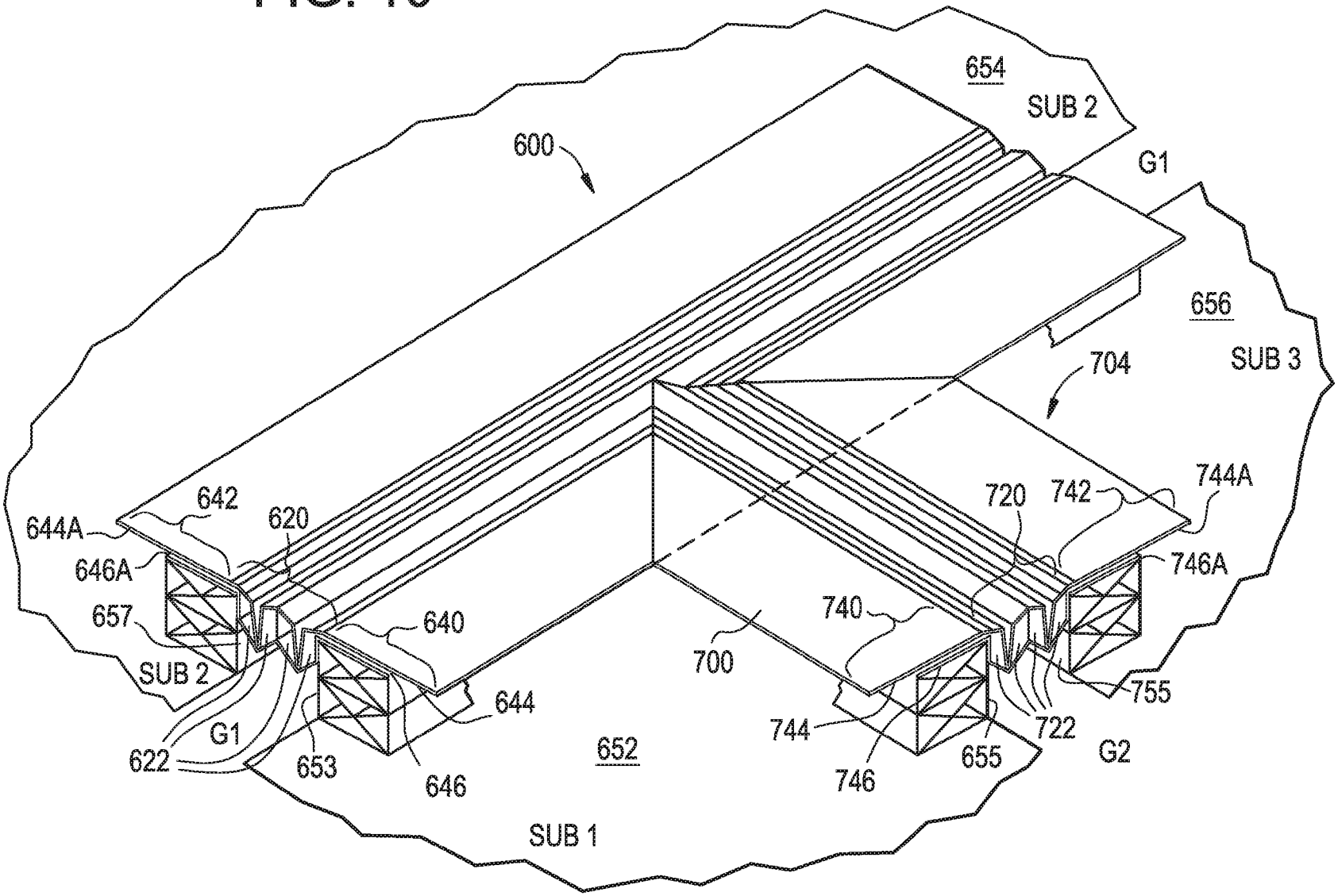
FIG. 10 is a perspective view of the expansion joint seal of FIG. 3 as installed at a T-intersection.

Referring to FIG. 10, expansion joint seals 600 and 700 are installed in a floor or deck having a T-shaped expansion joint or gaps G1 and G2. The expansion joint seal 600 is attached to a first substrate 652, a second substrate 654, and a third substrate 656. Similarly, the expansion joint seal 700 is attached to the first substrate 652 and the third substrate 656. In one embodiment, illustrated in FIG. 10, one or both of the expansion joint seals 600 and 700 are cut to taper at an intersection of the T-shaped joint or gaps G1 and G2. Alternatively, the expansion joint seal 700 is cut square to abut the expansion joint seal 600 at the intersection of T-shaped joint. As with the aforementioned expansion joint seals 100, 200, 300, 400, 500, central portions 620 and 720 of the expansion joint seals 600 and 700 are disposed in the gaps Gland G2 between side edges 653, 655, 657 and 755 of the first substrate 652, the second substrate 654 and the third substrate 656. In one embodiment, the expansion joint seal 600 and the expansion joint seal 700 are fused together, for example, with heat sealing or adhesive. The expansion joint seal 600 has a center portion 620 with four central chambers 622 formed therein and disposed within and sealing the gap G1. Similarly, the expansion joint seal 700 has a center portion 720 with four central chambers 722 formed therein and is disposed within and filling the gap G2. Still referring to FIG. 10, in one embodiment, when any one of the first substrate 652, the second substrate 654, and/or the third substrate 656 moves as a result of thermal expansion and contraction, wind sway, settlement, live load deflection, and/or seismic movement, the central portions 620 and/or 720 respond to maintain the watertight seal over the expansion joints G1 and/or G2.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or matter to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An expansion joint seal for a structure, the seal comprising:

a central portion including a sidewall comprising members, the sidewall configured to define at least one central chamber disposed around a centerline;

a first flange portion extending outwardly from the centerline; and a second flange portion extending outwardly from the centerline in a direction opposite the first flange portion;

wherein at least one of the first flange portion and the second flange portion is bifurcated into an upper flange portion and a lower flange portion, the lower flange portion being substantially parallel to the upper flange portion, and the upper flange portion extending further in length from the centerline than the lower flange portion, the thickness of each of the upper flange portion and the lower flange portion being planar and substantially the same as the thickness of the members of the sidewall;

wherein when installed on the structure the first flange portion is attachable to a first substrate of the structure and the second flange portion is attachable to a second substrate of the structure such that the central portion is disposed within and seals a gap formed between the first substrate and the second substrate of the structure; and wherein movement of one or both of the first substrate and the second substrate causes a response in the central portion to maintain the seal.

2. The joint seal of claim 1, wherein at least one of the first flange portion and the second flange portion is comprised of a flexible materials such that the at least one of the first flange portion and the second flange portion may be affixed to the structure at an angle or an elevation that differs from the central portion.

3. The joint seal of claim 1, further including a bracket disposed between the upper flange portion and the lower flange portion to facilitate mounting of the expansion joint seal to the structure.

4. The joint seal of claim 1, wherein when installed the upper flange portion and the lower flange portion interlay with two or more layers of materials.

5. The joint seal of claim 1, wherein expansion of at least one of the first substrate and second substrate causes the central portion to deflect upward such that the central portion does not impinge on itself or prevent movement of one or both of the first substrate and the second substrate while maintaining the seal.

6. The joint seal of claim 1 wherein contraction of at least one of the first substrate and the second substrate causes the central portion to deflect downward such that the central portion does not impinge on itself or prevent movement of one or both of the first substrate and the second substrate while maintaining the seal.

7. The joint seal of claim 1 wherein the central portion includes a sidewall, the sidewall configured to define the at least one central chamber, the at least one central chamber being configured to be selectively collapsible in response to a force from movement of one or both of the first substrate and the second substrate.

8. The joint seal of claim 7 wherein the at least one central chamber is comprised of at least one pair of central chambers disposed about the centerline.

9. The joint seal of claim 1 wherein the at least one central chamber is comprised of an odd number of central chambers.

* * * * *